US007990068B2

(12) United States Patent
Pan

(10) Patent No.: US 7,990,068 B2
(45) **Date of Patent: *Aug. 2, 2011**

(54) FIELD EMISSION LIGHT EMITTING DEVICE

(75) Inventor: David H. Pan, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 591 days.

This patent is subject to a terminal disclaimer.

(21) Appl. No.: 12/041,870

(22) Filed: Mar. 4, 2008

(65) Prior Publication Data

US 2009/0224680 A1 Sep. 10, 2009

(51) Int. Cl.
*G09G 3/10* (2006.01)

(52) U.S. Cl. ..... 315/169.1; 313/306

(58) Field of Classification Search .... 315/169.1–169.4; 313/294, 306–311, 495–497
See application file for complete search history.

(56) References Cited

U.S. PATENT DOCUMENTS

| | | | | |
|---|---|---|---|---|
| 6,538,367 | B1 * | 3/2003 | Choi et al. | 313/309 |
| 6,630,772 | B1 * | 10/2003 | Bower et al. | 313/311 |
| 6,650,061 | B1 * | 11/2003 | Urayama et al. | 315/169.3 |
| 6,858,981 | B2 | 2/2005 | Cho et al. | |
| 7,102,278 | B2 | 9/2006 | Oh et al. | |
| 7,189,435 | B2 | 3/2007 | Tuominen et al. | |
| 7,221,087 | B2 * | 5/2007 | Liu et al. | 313/497 |
| 7,239,076 | B2 | 7/2007 | Lee et al. | |
| 2002/0055239 | A1 | 5/2002 | Tuominen et al. | |
| 2002/0079802 | A1 | 6/2002 | Inoue et al. | |
| 2006/0244357 | A1 | 11/2006 | Lee | |
| 2006/0267476 | A1 | 11/2006 | Jeon et al. | |
| 2009/0051853 | A1 * | 2/2009 | Thomas et al. | 349/86 |
| 2009/0051863 | A1 * | 2/2009 | Meisner | 349/143 |
| 2009/0302738 | A1 | 12/2009 | Pan et al. | |

OTHER PUBLICATIONS

T. Thurn-Albrecht et al., "*Ultrahigh-Density Nanowire Arrays Grown in Self-Assembled Diblock Copolymer Templates*," Science, vol. 290, pp. 2126-2129, Dec. 15, 2000.

Park et al., "*Large Area Dense Nanoscale Patterning of Arbitrary Surfaces*," Applied Physics Letters, vol. 79, No. 2, pp. 257-259, Jul. 9, 2001.

* cited by examiner

*Primary Examiner* — Jacob Y Choi
*Assistant Examiner* — Jimmy T Vu
(74) *Attorney, Agent, or Firm* — MH2 Technology Law Group LLP

(57) ABSTRACT

In accordance with the invention, there are nanoscale electron emitters, field emission light emitting devices, and methods of forming them. The nanoscale electron emitter can include a first electrode electrically connected to a first power supply and a second electrode electrically connected to a second power supply. The nanoscale electron emitter can also include a nanocylinder electron emitter array disposed over the second electrode, the nanocylinder electron emitter array having a plurality of nanocylinder electron emitters disposed in a dielectric matrix, wherein each of the plurality of nanocylinder electron emitters can include a first end connected to the second electrode and a second end positioned to emit electrons, the first end being opposite to the second end.

22 Claims, 10 Drawing Sheets

FIELD EMISSION LIGHT EMITTING DEVICE

DESCRIPTION OF THE INVENTION

1. Field of the Invention

The present invention relates to light emitting devices and more particularly to field emission light emitting devices and methods of forming them.

2. Background of the Invention

A field emission display is a display device in which electrons are emitted from a field emitter arranged in a predetermined pattern including cathode electrodes by forming a strong electric field between the field emitter and at least another electrode. Light is emitted when electrons collide with a fluorescent or phosphorescent material coated on an anode electrode. A micro-tip formed of a metal such as molybdenum (Mo) is widely used as the field emitter. A new class of carbon nanotubes (CNT) electron emitters are now being actively pursued for use in the next generation field emission device (FED). There are several methods of forming a CNT emitter, but they all suffer from general problems of fabrication yield, light emitting uniformity, and lifetime stability because of difficulty in organizing the CNT emitters consistently.

Accordingly, there is a need for developing a new class of electron emitters and methods of forming them.

SUMMARY OF THE INVENTION

In accordance with various embodiments, there is a nanoscale electron emitter. The nanoscale electron emitter can include a first electrode electrically connected to a first power supply and a second electrode electrically connected to a second power supply. The nanoscale electron emitter can also include a nanocylinder electron emitter array disposed over the second electrode, the nanocylinder electron emitter array having a plurality of nanocylinder electron emitters disposed in a dielectric matrix, wherein each of the plurality of nanocylinder electron emitters can include a first end connected to the second electrode and a second end positioned to emit electrons, the first end being opposite to the second end.

According to various embodiments, there is field emission light emitting device. The field emission light emitting device can include a substantially transparent substrate, a plurality of spacers, wherein each of the plurality of spacers connects the substantially transparent substrate to a backing substrate, and a plurality of pixels, each of the plurality of pixels separated by one or more spacers, and wherein each of the plurality of pixels can be connected to a power supply and can be operated independent of the other pixels. Each of the plurality of pixels can include one or more first electrodes disposed over the substantially transparent substrate, wherein each of the one or more first electrodes includes a substantially transparent conductive material. Each of the plurality of pixels can also include a light emitting layer disposed over the one of the one or more first electrodes and one or more second electrodes disposed over each of the plurality of spacers, wherein the second electrodes are disposed at an angle to the first electrodes. Each of the plurality of pixels can further include one or more nanocylinder electron emitter arrays disposed over each of the one or more second electrodes, the nanocylinder electron emitter array including a plurality of nanocylinder electron emitters disposed in a dielectric matrix, wherein each of the plurality of nanocylinder electron emitters includes a first end connected to the second electrode and a second end positioned to emit electrons, wherein the one or more second electrodes and the one or more first electrode can be disposed at a predetermined gap in a low pressure region.

According to yet another embodiment, there is a field emission light emitting device including a substantially transparent substrate and a plurality of spacers, wherein each of the plurality of spacers connects the substantially transparent substrate to a backing substrate. The field emission light emitting device can also include a plurality of pixels, each of the plurality of pixels separated by one or more spacers, and wherein each of the plurality of pixels can be connected to a power supply and can be operated independent of the other pixels. Each of the plurality of pixels can include one or more first electrodes disposed over the substantially transparent substrate, wherein the one or more first electrodes can include a substantially transparent conductive material. Each of the plurality of pixels can also include a light emitting layer disposed over the first electrode and one or more second electrodes disposed over the substantially transparent substrate. Each of the plurality of pixels can further include one or more nanocylinder electron emitter arrays disposed over the one or more second electrodes, the plurality of nanocylinder electron emitter arrays including a plurality of nanocylinder electron emitters, wherein each of the plurality of nanocylinder electron emitters includes a first end connected to the second electrode and a second end positioned to emit electrons.

Additional advantages of the embodiments will be set forth in part in the description which follows, and in part will be obvious from the description, or may be learned by practice of the invention The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less that 10" can assume negative values, e.g. −1, −2, −3, −10, −20, −30, etc.

Figure 1A:
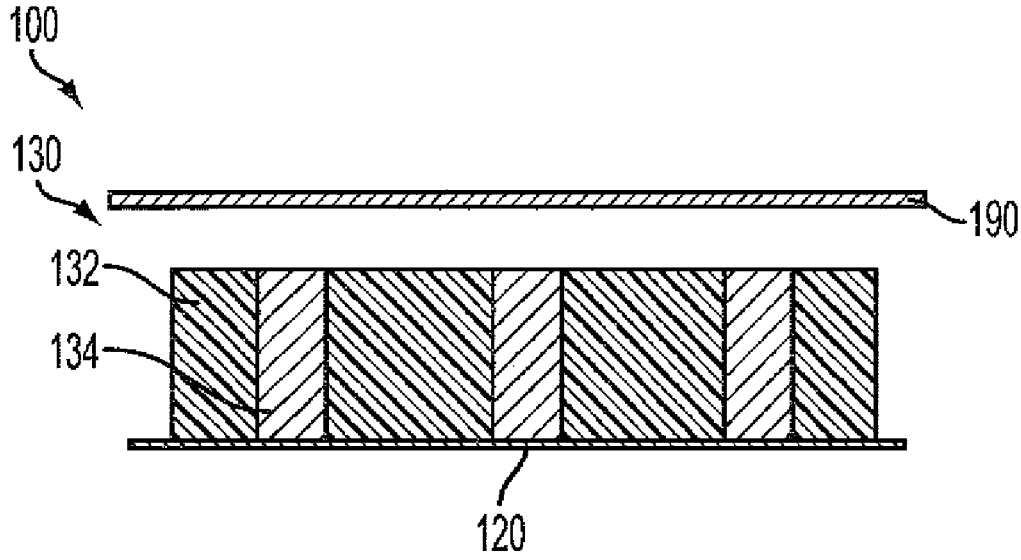
FIGS. 1A-1D illustrate exemplary nanoscale electron emitter, according to various embodiments of the present teachings.

FIG. 1A illustrates an exemplary nanoscale electron emitter 100, according to various embodiments of the present teachings. The nanoscale electron emitter 100 can include a first electrode 190 electrically connected to a first power supply (not shown), a second electrode 120 electrically connected to a second power supply (not shown), and a nanocylinder electron emitter array 130 disposed over the second electrode 120, the nanocylinder electron emitter array 130 having a plurality of nanocylinder electron emitters 134 disposed in a dielectric matrix 132, wherein each of the plurality of nanocylinder electron emitters 134 can include a first end connected to the second electrode 120 and a second end positioned to emit electrons, the first end being opposite to the second end. In various embodiments, each of the plurality of nanocylinder electron emitters 134 can have an aspect ratio of more than about 2. In some embodiments, the second electrode 120 can include any metal with a low work function, including, but not limited to, molybdenum and tungsten. In other embodiments, the second electrode 120 can include any suitable doped semiconductor. In various embodiments, each of the plurality of nanocylinder electron emitters 134 can include any metal with a low work function, including, but not limited to, molybdenum and tungsten. In some embodiments, the dielectric matrix 132 can include one or more materials selected from a group consisting of a polymer, a block copolymer, a polymer blend, a crosslinked polymer, a track-etched polymer, and an anodized aluminum.

Figure 1B:
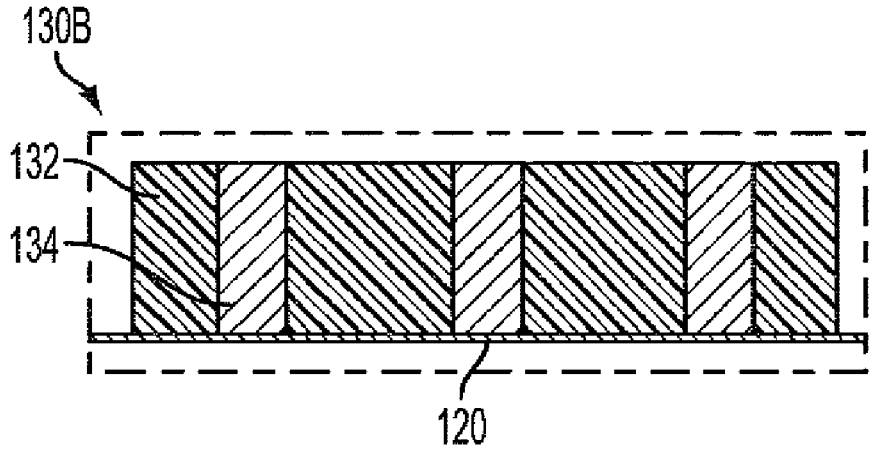
Figure 1C:
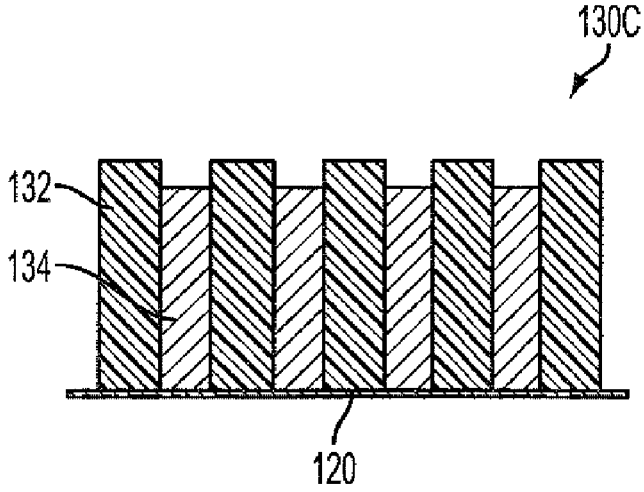

In some embodiments, the nanocylinder electron emitter array 130 can be a low density nanocylinder electron emitter array 130B, having an areal density of less than about $10^9$ cylinders/$cm^2$, as shown in FIG. 1B. In various embodiments, each of the plurality of nanocylinder electron emitters 134 can be disposed in the dielectric matrix 132, such that an average nanocylinder electron emitter 134 to nanocylinder electron emitter 134 distance can be at least about an average height of the nanocylinder electron emitter 134. In some embodiments, the nanocylinder electron emitters 134 can be free standing (not shown) over the second electrode 120. In other embodiments, the dielectric matrix 132 can be somewhere between the first end and the second end of the nanocylinder electron emitters 134, as shown in FIG. 1C.

Figure 1D:
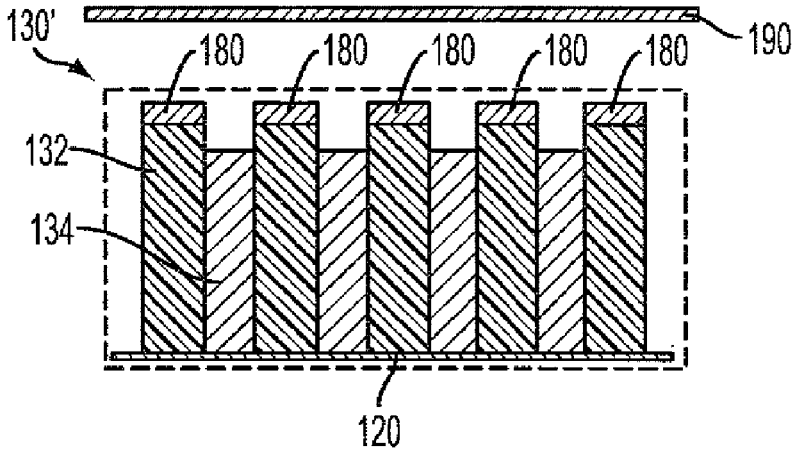

FIG. 1D shows another exemplary nanocylinder electron emitter array 130'. The nanocylinder electron emitter array 130' can include a plurality of nanocylinder electron emitters 134 disposed in the dielectric matrix 132 such that an average nanocylinder electron emitter 134 to nanocylinder electron emitter 134 distance can be at least about one and a half times an average diameter of the nanocylinder electron emitter 134, as shown in FIG. 1D. The nanocylinder electron emitter array 130' can also include a third electrode 180 disposed over the dielectric matrix 132 and electrically connected to a third power supply (not shown) such that a distance between the third electrode 180 and the second end of the nanocylinder electron emitter 134 can be less than about five times the average diameter of the nanocylinder electron emitter 134.

Simulation has shown that the performance of a nanocylinder electron emitter array 130, 130B, 130C can depend on the nanocylinder diameter, aspect ratio, and nanocylinder-to-nanocylinder distance. If the aspect ratio is too small, the conductive substrate, such as the second electrode 120 can negatively impact the field emission efficiency. In various embodiments, each of the plurality of the nanocylinder electron emitters 134 can have an aspect ratio from approximately 2 to approximately 6. If the nanocylinder electron emitter 134 to nanocylinder electron emitter 134 distance is too small, the field interference by the neighboring nanocylinder electron emitters 134 can negatively impact the local electric field. If the nanocylinder electron emitter 134 to nanocylinder electron emitter 134 distance is too large, the emission current density can be insufficient. The simulation results indicate that the suitable nanocylinder electron emitter 134 to nanocylinder electron emitter 134 distance can be from about 6 to about 18 times the average diameter of the nanocylinder electron emitter 134. However, it is extremely difficult to produce such nanocylinder electron emitter 134 to nanocylinder electron emitter 134 distance using conventional method of using neat diblock copolymer. For example, the polystyrene-polymethylmethacrylate diblock copolymer can result in a nanocylinder array density of about $2\times10^{11}$ cylinders/$cm^2$, which is at least an order of magnitude higher than desirable density. One of ordinary skill in the art can use any suitable method to form a low density nanocylinder array, such as, for example, track etched polymer based method and Anopore™, porous aluminum oxide based method. Another suitable method to form a low density nanocylinder array can use a diblock copolymer/homopolymer blend as the low density nanolithographic mask, such as, for example, A/B diblock copolymer/A homopolymer blend and A/B diblock copolymer/C homopolymer blend. The addition of a homopolymer (A or C) to an AB diblock copolymer is to increase the distance between the nanophase separated B sphere domains, thereby lowering the density of the B domains. A nanofabrication approach using only diblock copolymer is disclosed in, "Large area dense nanoscale patterning of arbitrary surfaces", Park, M.; Chaikin, P. M.; Register, R. A.; Adamson, D. H. *Appl. Phys. Lett.,* 2001, 79(2), 257, which is incorporated by reference herein in its entirety. Exemplary polymers for making block copolymers and for making block copolymer/homopolymer blend can include, but are not limited to polystyrene, polyisoprene, poly(butyl acrylate), poly(methyl methacrylate), poly(n-butyl methacrylate), poly(4-vinylpyridine), poly(2-ethyl hexyl acrylate), poly(2-hydroxyl ethyl acrylate), poly(neopentyl acrylate), poly(hydroxyl ethyl methacrylate), poly(trifluoroethyl methacrylate), polybutadiene, poly(dimethyl siloxane), poly (ethylene propylene), poly(isobutylene), poly(cylcohexyl methacrylate), poly(L-lactide), poly(butyl styrene), poly(hydroxyl styrene), poly(vinyl naphthalene), poly(acrylic acid), poly(ethylene oxide), poly(propylene oxide), poly(methacrylic acid), polyacrylamide, poly(styrenesulfonic acid). Non limiting exemplary diblock copolymer can be polystyrene/polyisoprene diblock copolymer. While, polystyrenelpolyisoprene diblock copolymer can produce an ordered array of nanocylinders with a constant nanocylinder-to-nanocylinder distance, the polystyrene-polystyrene/polyisoprene blend can be expected to produce an array of nanocylinders dispersed statistically, rather than regularly. However, this is acceptable for the nanocylinder electron emitter array application because there is no need to address each individual nanocylinder electron emitter. For example, a 2400 dpi pixel ($10.8\times10.8\ \mu m^2$) requires addressing of an ensemble of about 1,000 nanocylinders altogether. The resulting array using the polystyrene-polystyrene/polyisoprene blend can have an area density as low as about $10^9$ cylinders 1 $cm^2$, as shown schematically in FIG. 1B. In various embodiments, each of the plurality of nanocylinder electron emitters 134 can have a diameter from about 3 nm to about 100 nm.

Figure 2A:
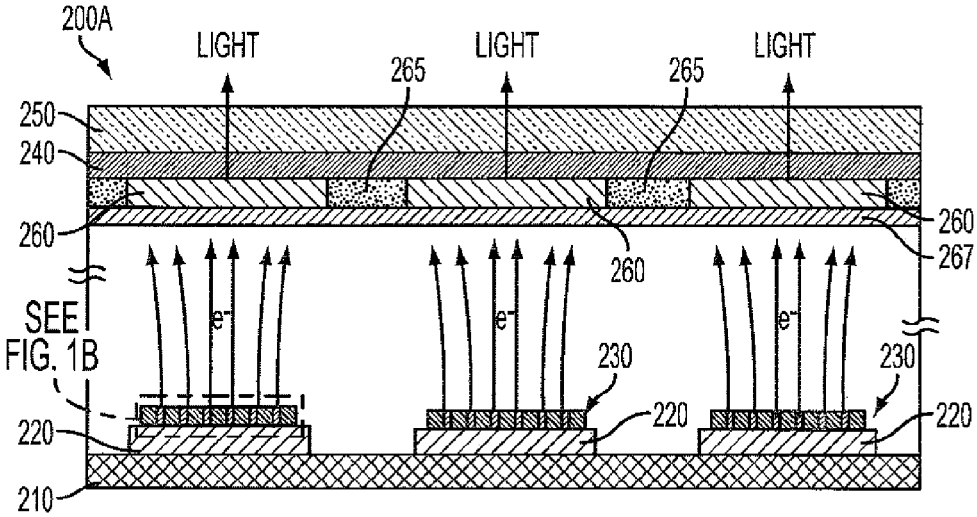
FIGS. 2A-2C illustrate exemplary field emission light emitting devices, according to various embodiments of the present teachings.
Figure 2B:
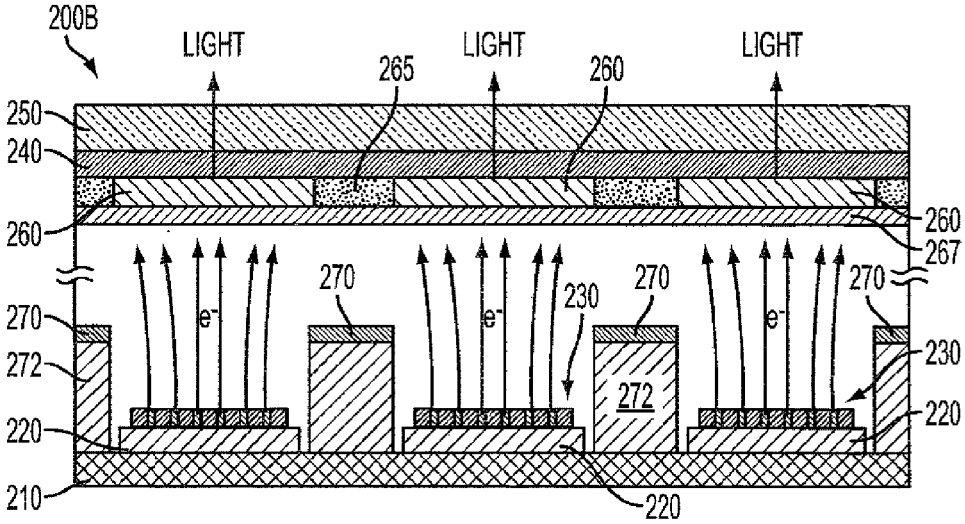

FIGS. 2A and 2B illustrate exemplary field emission light emitting devices (FELED) 200A, 200B according to various embodiments of the present teachings. The FELED 200A, 200B can include one or more first electrodes 240 disposed over a substantially transparent substrate 250, wherein each of the one or more first electrodes 240 can include a substantially transparent conductive material. Exemplary materials for the first electrode 240 can include, but are not limited to indium tin oxide (ITO), vapor deposited titanium, and thin layer of conductive polymers. The FELED 200A, 200B, as shown in FIGS. 2A and 2B can also include a plurality of light emitting layers 260 disposed over each of the one or more first electrodes 240. In various embodiments, the plurality of light emitting layers 260 can include one or more of a first plurality of light emitting phosphor layers having a first color, a second plurality of light emitting phosphor layers having a second color, and a third plurality of light emitting phosphor layers having a third color. The FELED 200A, 200B can also include a backing substrate 210 and a plurality of second electrodes 220 disposed over the backing substrate 210. In various embodiments, the plurality of second electrodes 220 and the one or more first electrodes 240 can be disposed at a predetermined gap in a low pressure region. Any suitable material can be used for the backing substrate 210. In some embodiments, each of the plurality of second electrodes 220 can include any metal with a low work function, including, but not limited to, molybdenum and tungsten. In other embodiments, each of the plurality of second electrodes 220 can include any suitable doped semiconductor. The FELED 200A, 200B as shown in FIGS. 2A and 2B can also include a plurality of nanocylinder electron emitter arrays 230 having a desired density of nanocylinder electron emitters 134 as shown in FIG. 1B, disposed over the plurality of second electrodes 220, wherein each of the plurality of nanocylinder electron emitter 134 can include a first end connected to the second electrode 220 and a second end positioned to emit electrons. In some embodiments, the nanocylinder electron emitter array 230 can be a low density nanocylinder electron emitter array 130B shown in FIG. 1B, having an areal density of less than about $10^9$ cylinders/$cm^2$, as shown in FIGS. 2A and 2B.

In some embodiments, the FELED 200A, 200B can also include a thin metal layer 267 disposed over the light emitting layer 260 to improve the withstand voltage and the brightness characteristics of the FELED 200A, 200B. In other embodiments, the FELED 200A, 200B can include one or more contrast matrix layers 265 disposed over the first electrode 240, in between each of the plurality of light emitting layers 260, as shown in FIGS. 2A and 2B.

The FELED 200A, 200B can be driven by applying suitable voltages to the one or more of the first electrodes 240 and the plurality of the second electrodes 220. In some embodiments, a negative voltage from about 1V to about 100 V can be applied to the second electrode 220 and a positive voltage from about 10V to about 1000 V can be applied to the first electrode 240. The voltage difference between the second electrode 220 and the first electrode 240 can create a field around the nanocylinder electron emitters 134 as shown in FIG. 1B, so that electrons can be emitted. The electrons can then be guided by the high voltage applied to the first electrode 240 bombard the light emitting layer 260 disposed over the first electrode 240. As a result of electron bombardment, the light emitting layer 260 can emit light. In various embodiments, the FELED 200A can also include a light emitting layer 260 with an on-off control. In an exemplary on-off control, a constant voltage can be applied to the first electrode 240, while only desired second electrodes 220 can be supplied with a voltage to emit electrons and as a result light can be emitted only from the desired pixels.

Figure 2C:
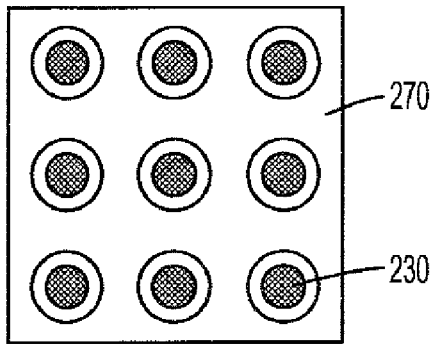

In some embodiments, the FELED 200B can include a plurality of fourth electrodes 270 disposed above the second electrodes 220, as shown in FIG. 2B. FIG. 2C illustrates top view of the FIG. 2B. In various embodiments, each of the plurality of fourth electrodes 270 can include any suitable conductive material. In some embodiments, the fourth electrode 270 can be disposed over a dielectric layer 272. In various embodiments, the plurality of fourth electrodes 270 can be disposed below the plurality of second electrodes 220 (not shown). The FELED 200B can be driven by applying a negative voltage from about 1V to about 10V to the second electrode 220, a negative voltage from about 1V to about 100V to the fourth electrode 270, and a positive voltage from about 10V to about 1000V to the first electrode 240. Furthermore, in this embodiment, the electrons emitted by the nanocylinder electron emitters 134 as shown in FIG. 1B due to the voltage difference between the second electrode 220 and the fourth electrode 270, are pushed by the fourth electrode 270.

FIGS. 3A-3D illustrate exemplary field emission light emitting device (FELED) 300A, 300B, 300C, 300D, according to various embodiments of the present teachings. The FELED 300A, 300B, 3000, 300D can include a substantially transparent substrate 350 and a plurality of spacers 390, wherein each of the plurality of spacers 390 can connect the substantially transparent substrate 350 to a backing substrate 310. The FELED 300A, 300B, 300C, 300D can also include a plurality of pixels 301A, 301B, 301C, 301D, wherein each of the plurality of pixels 301A, 301B, 301C, 301D can be separated by one or more spacers 390, as shown in FIGS. 3A-3D and wherein each of the plurality of pixels 301A, 301B, 301C, 301D can be connected to a power supply (not shown) and can be operated independent of the other pixels 301A, 301B, 301C, 301D. In various embodiments, each of the plurality of pixels 301A, 301B, 301C, 301D can include one or more first electrodes 340 disposed over the substantially transparent substrate 350, wherein the first electrode 340 can include a substantially transparent conductive material, such as, for example, indium tin oxide (ITO), vapor deposited titanium, and thin layer of conductive polymers. Each of the plurality of pixels 301A, 301B, 301C, 301D can also include a light emitting layer 362, 364, 366 disposed over the one of the one or more first electrodes 340 and one or more second electrodes 320 disposed over each of the plurality of spacers 390, wherein the second electrodes 320 can be disposed at an angle to the first electrodes 340. Each of the plurality of pixels 301A, 301B, 301C, 301D can further include one or more nanocylinder electron emitter arrays 330, 330' disposed over each of the one or more second electrodes 320, the nanocylinder electron emitter array 330, 330' including a plurality of nanocylinder electron emitters 134 as shown in FIGS. 1B and 1D disposed in a dielectric matrix 132, wherein each of the plurality of nanocylinder electron emitters 134 can include a first end connected to the second electrode 340 and a second end positioned to emit electrons. In various embodiments, the one or more second electrodes 320 and the first electrode 340 can be disposed at a predetermined gap in a low pressure region. In various embodiments, the dielectric matrix 132 can include one or more materials selected from a group consisting of a polymer, a block copolymer, a polymer blend, a crosslinked polymer, a track-etched polymer, and an anodized aluminum.

Figure 3A:
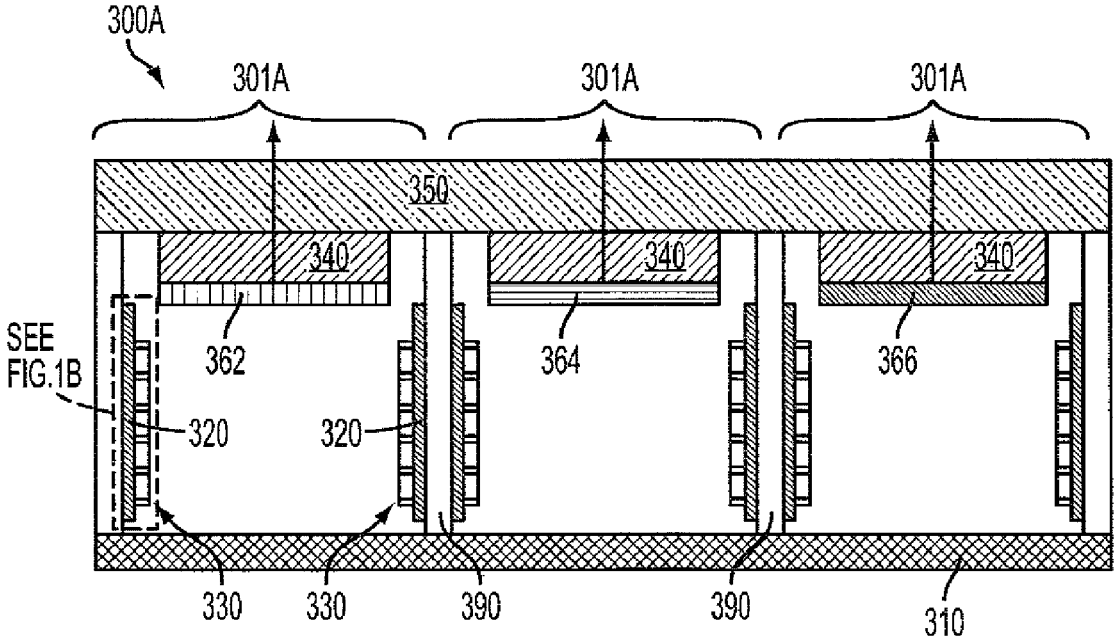
FIGS. 3A-3D illustrate another exemplary field emission light emitting devices, according to various embodiments of the present teachings.

In various embodiments, each of the plurality of nanocylinder electron emitters 134 in the FELED 300A, 300B, 300C, 300D can have an aspect ratio of more than about 2. In some embodiments, such as, FELED 300A, 300B, an average nanocylinder electron emitter 134 to nanocylinder electron emitter 134 distance can be at least about an average height of the nanocylinder electron emitter 134, as shown in FIGS. 3A and 3B.

Figure 3B:
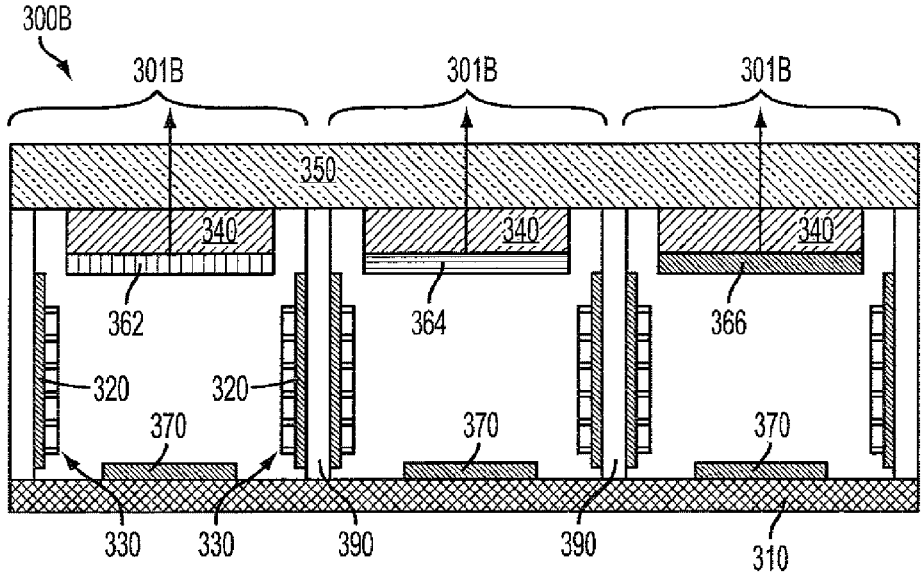
Figure 3C:
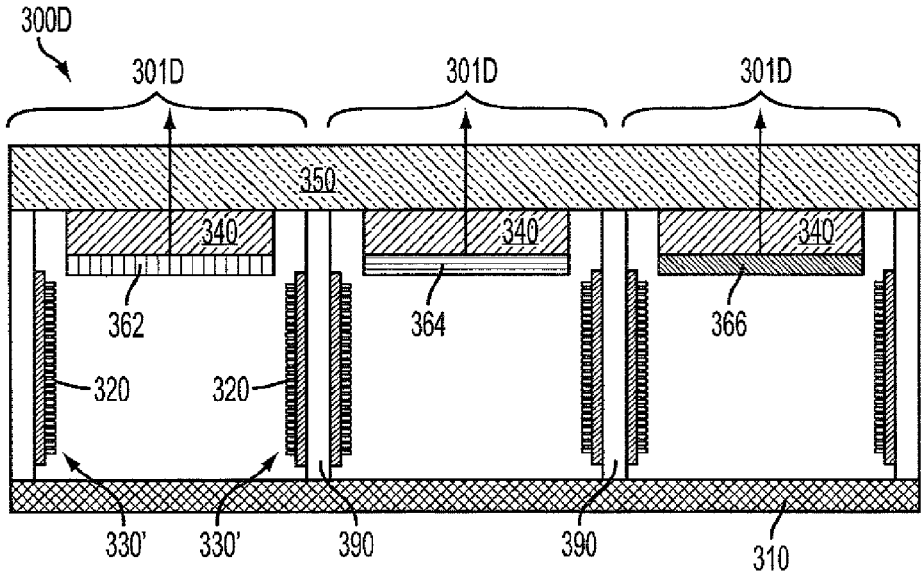
Figure 3D:
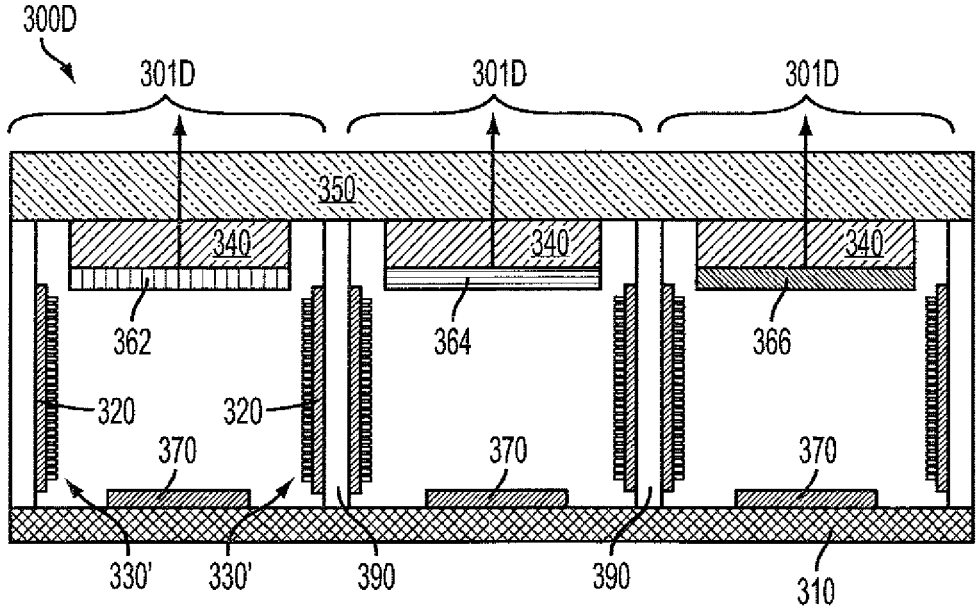

In various embodiments, the FELED 300C, 300D, as shown in FIGS. 3C and 3D can include one or more nanocylinder electron emitter arrays 330' in each of the plurality of pixels 301C, 301D. Each of the one or more nanocylinder electron emitter arrays 330' can include a plurality of nanocylinder electron emitters 134 as shown in FIG. 1B, disposed in a dielectric matrix 132 such that an average nanocylinder electron emitter 134 to nanocylinder electron emitter 134 distance can be at least about one and a half times an average diameter of the nanocylinder electron emitter. Each of the one or more nanocylinder electron emitter arrays 330' can also include a third electrode 180 disposed over the dielectric matrix 132 such that a distance between the third electrode 180 and the second end of the nanocylinder electron emitter 134 can be less than about five times the diameter of the nanocylinder electron emitter 134. In various embodiments, the nanocylinder electron emitter array 330' can have an areal density of more than about $10^9$ cylinders/$cm^2$.

In various embodiments, each of the plurality of pixels 301B, 301D can further include one or more fourth electrodes 370 disposed over the backing substrate 310, as shown in FIGS. 3B and 3D.

In various embodiments, each of the plurality of pixels 301A, 301B, 301C, 301D can include a light emitting layer 362, 364, 366 including a light emitting phosphor material having a light emitting color selected from a group consisting of red, green, blue, and combinations thereof. For example, the light emitting layer 362 can have a red light emitting phosphor material, the light emitting layer 364 can have a green light emitting phosphor material, and the light emitting layer 366 can have a blue light emitting phosphor material. In some embodiments, each of the plurality of spacers 390 can include one or more contrast enhancing materials. In other embodiments, the FELED 300A, 300B, 300C, 300D can further include a plurality of voltage withstand layers (not shown), wherein each of the plurality of voltage withstand layers can be disposed over the light emitting layer 362, 364, 366.

FIGS. 4A-4E illustrate exemplary field emission light emitting device (FELED) 400A, 400C, 400D, 400E according to various embodiments of the present teachings. The FELED 400A, 400B, 400C, 400D can include a substantially transparent substrate 450, a plurality of spacers 490, wherein each of the plurality of spacers 490 can connect the substantially transparent substrate 450 to a backing substrate 410, and a plurality of pixels 401A, 401C, 401D, 401E, wherein each of the plurality of pixels can be separated by one or more spacers 490, as shown in FIGS. 4A-4E. In various embodiments, each of the plurality of pixels 401A, 401C, 401D, 401E can include one or more first electrodes 440 disposed over the substantially transparent substrate 450, a light emitting layer 462, 464, 466 disposed over the first electrode 440, and one or more second electrodes 420 disposed over the substantially transparent substrate 450. Each of the plurality of pixels 401A, 401C, 401D, 401E can also include one or more nanocylinder electron emitter arrays 430, 430' disposed over the one or more second electrodes 420, the plurality of nanocylinder electron emitter arrays 430, 430' including a plurality of nanocylinder electron emitters 134 as shown in FIGS. 1B and 1D, wherein each of the plurality of nanocylinder electron emitters 134 can include a first end connected to the second electrode 420 and a second end positioned to emit electrons. Each of the plurality of pixels 401A, 401C, 401D, 401E can be connected to a power supply (not shown) and can be operated independent of the other pixels 401A, 401C, 401D, 401E. In some embodiments, the one or more first electrodes 440 can include a substantially transparent conductive material, such as, for example, indium tin oxide (ITO), vapor deposited titanium, and thin layer of conductive polymers.

Figure 4A:
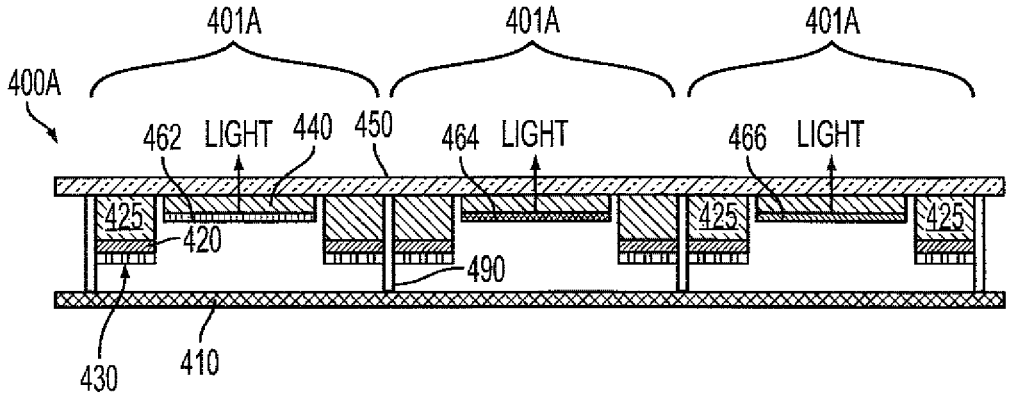
FIGS. 4A-4E illustrates exemplary field emission light emitting devices, according to various embodiments of the present teachings.
Figure 4B:
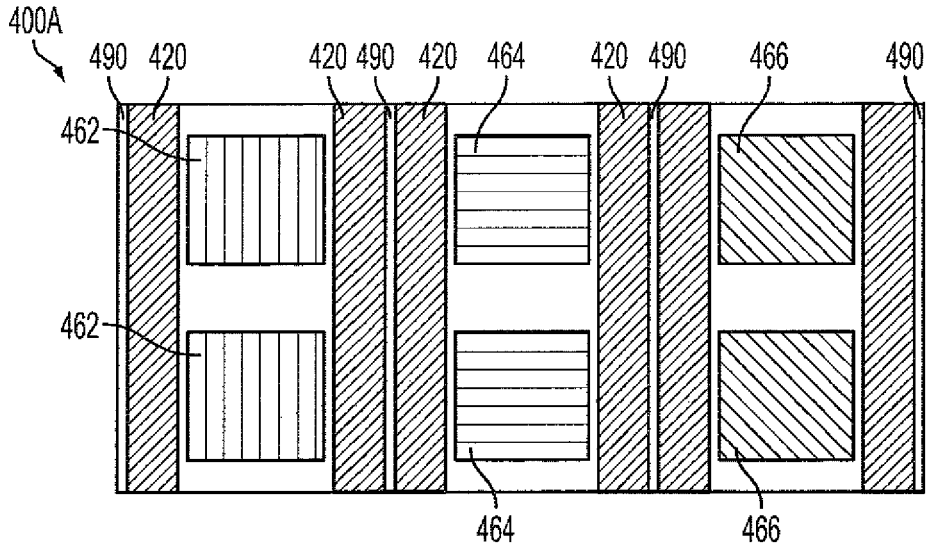
Figure 4C:
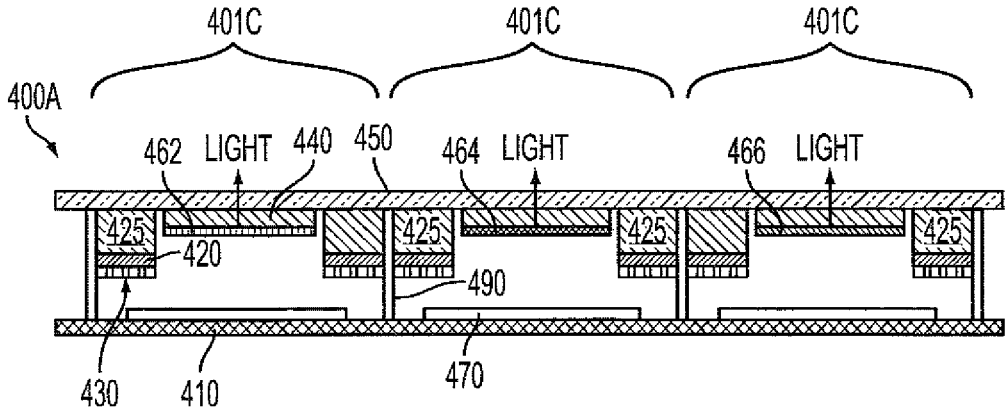

In various embodiments, each of the plurality of nanocylinder electron emitters 134 as shown in FIG. 1B in the FELED 400A, 400C, 400D, 400E can have an aspect ratio of more than about 2. In some embodiments, such as, FELED 400A, 400C, an average nanocylinder electron emitter 134 to nanocylinder electron emitter 134 distance can be at least about an average height of the nanocylinder electron emitter 134, as shown in FIGS. 4A and 4C.

Figure 4D:
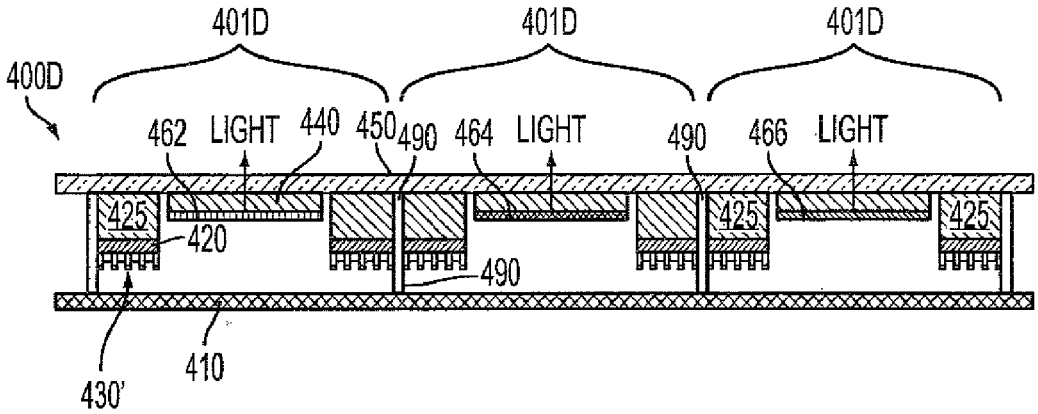
Figure 4E:
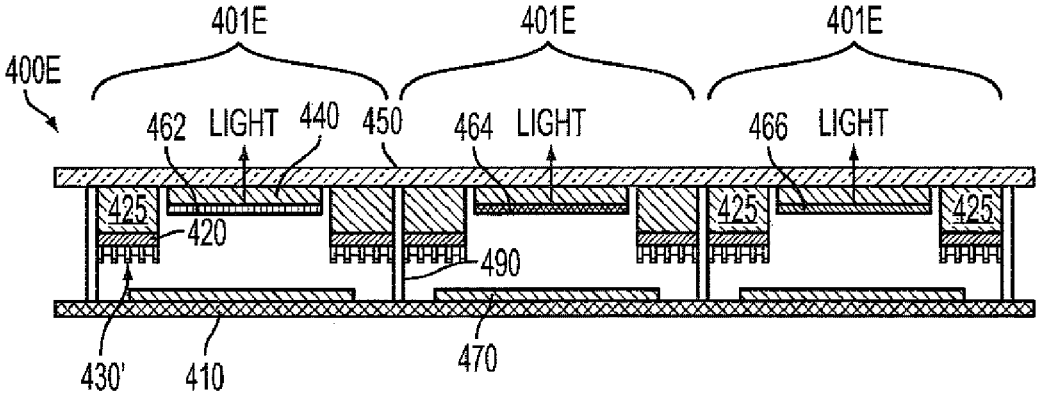

In various embodiments, the FELED 400C, 400D, as shown in FIGS. 4D and 4E can include one or more nanocylinder electron emitter arrays 430' in each of the plurality of pixels 401C, 401D. Each of the one or more nanocylinder electron emitter arrays 430' can include a plurality of nanocylinder electron emitters 134 as shown in FIG. 1D disposed in a dielectric matrix 132 such that an average nanocylinder electron emitter 134 to nanocylinder electron emitter 134 distance can be at least about one and a half times an average diameter of the nanocylinder electron emitter. Each of the one or more nanocylinder electron emitter arrays 430' can also include a third electrode 180 disposed over the dielectric matrix 132 such that a distance between the third electrode 180 and the second end of the nanocylinder electron emitter 134 can be less than about five times the diameter of the nanocylinder electron emitter 134. In various embodiments, the nanocylinder electron emitter array 430' can have an areal density of more than about $10^9$ cylinders/$cm^2$.

In various embodiments, each of the plurality of pixels 401A, 401C, 401D, 401E can include a light emitting layer 462, 464, 466 including a light emitting phosphor material having a light emitting color selected from a group consisting of red, green, blue, and combinations thereof. In other embodiments, the FELED 400A, 400C, 400D, 400E can further include a plurality of voltage withstand layers (not shown), wherein each of the plurality of voltage withstand layers can be disposed over the light emitting layer 462, 464, 466.

Each of the plurality of pixels 401A, 401D in the FELED 400A, 400D can be connected to a power supply (not shown) and can be operated independent of the other pixels. Each pixel can be driven by applying a negative voltage to the second electrode 420, and a suitable positive voltage to the first electrode 440. The voltage difference between the second electrode 420 and the first electrode 440 can generate an electric field around the nanocylinder electron emitter arrays 430, 430' which can result in an electron emission. The emitted electrons can then be guided by the applied positive voltage to the first electrode 440 in such a manner that they make substantially a 180° turn. The emitted electrons can then collide with the light emitting layer 462, 464, 466 to emit light. The operating electric field strength can be from about 1 volts/μm to about 15 volts/μm, and in some cases from about 3 volts/μm to about 8 volts/μm, and in other cases from about 4 volts/μm to about 6 volts/μm. For an exemplary average operating electric field strength of about 5 volts/μm in a FELED 400A, 400C, 400D, 400E that has a distance between the second electrode 420 and the first electrode 440 from about 10 μm to about 30 μm, the operating voltage difference between the second electrode 420 and the first electrode 440 can be from about 50 volts to about 150 volts. In various embodiments, the voltages applied to the first electrode 440 and the second electrode 420 can be from about 10V to about 100V. In some embodiments, the second electrode 420 can always have a constant voltage while the first electrode 440 can be turned on or off. In other embodiments, each of the plurality of the pixels 401A, 401D can be driven by turning suitable voltage on or off the second electrode 420. FIG. 4B shows a bottom view of an exemplary FELED 400A, wherein the second electrodes 420 can be strip shaped to increase the electron emitting area. In various embodiments, each of the plurality of the pixels 401A, 401D can be driven by applying a constant voltage to the second electrode 420, while the light emission can be controlled by applying a suitable voltage to each of the one or more first electrodes 440.

In various embodiments, each of the plurality of pixels 401C, 401E can further include one or more fourth electrodes 470 disposed over the backing substrate 410, as shown in FIGS. 4C and 4E.

Each of the plurality of pixels 401C, 401E in the FELED 400C, 400E can be connected to a power supply (not shown) and can be operated independent of the other pixels. Each pixel can be can be driven by applying a suitable negative voltage to the second electrode 420, and suitable positive voltages to the fourth electrode 470 and the first electrode 440. The electric field generated around the nanocylinder electron emitter array 430, 430' by the voltages on the second electrode 420, the first electrode 440, and the fourth electrode 470 can cause electron emission. The emitted electrons can then be guided by the voltage applied to the first electrode 440 and the fourth electrode 470 to collide with the light emitting layers 462, 464, 466 to emit light. In various embodiments, the operating electric field strength to cause emission of electrons can be from about 1 volts/μm to about 15 volts/μm, and in some cases from about 3 volts/μm to about 8 volts/μm, and in other cases from about 4 volts/μm to about 6 volts/μm. In various embodiments, the voltages applied to the first electrode 440, the second electrode 420, and the fourth electrode 470 can be from about 10V to about 100V. In some embodiments, the second electrode 420 can always have a constant voltage while the light emission can be controlled by controlling the voltage applied to the first electrode 440 and/or the fourth electrode 470. In another embodiment, the first electrode 440 and/or the fourth electrode 470 can always have a constant voltage while the light emission can be controlled by controlling the voltage applied to the second electrode 420. In yet another embodiment, light emission can be controlled by controlling the voltage applied to the fourth electrode 470 while applying constant voltages to the second electrode 420 and the first electrode 440.

Figure 5:
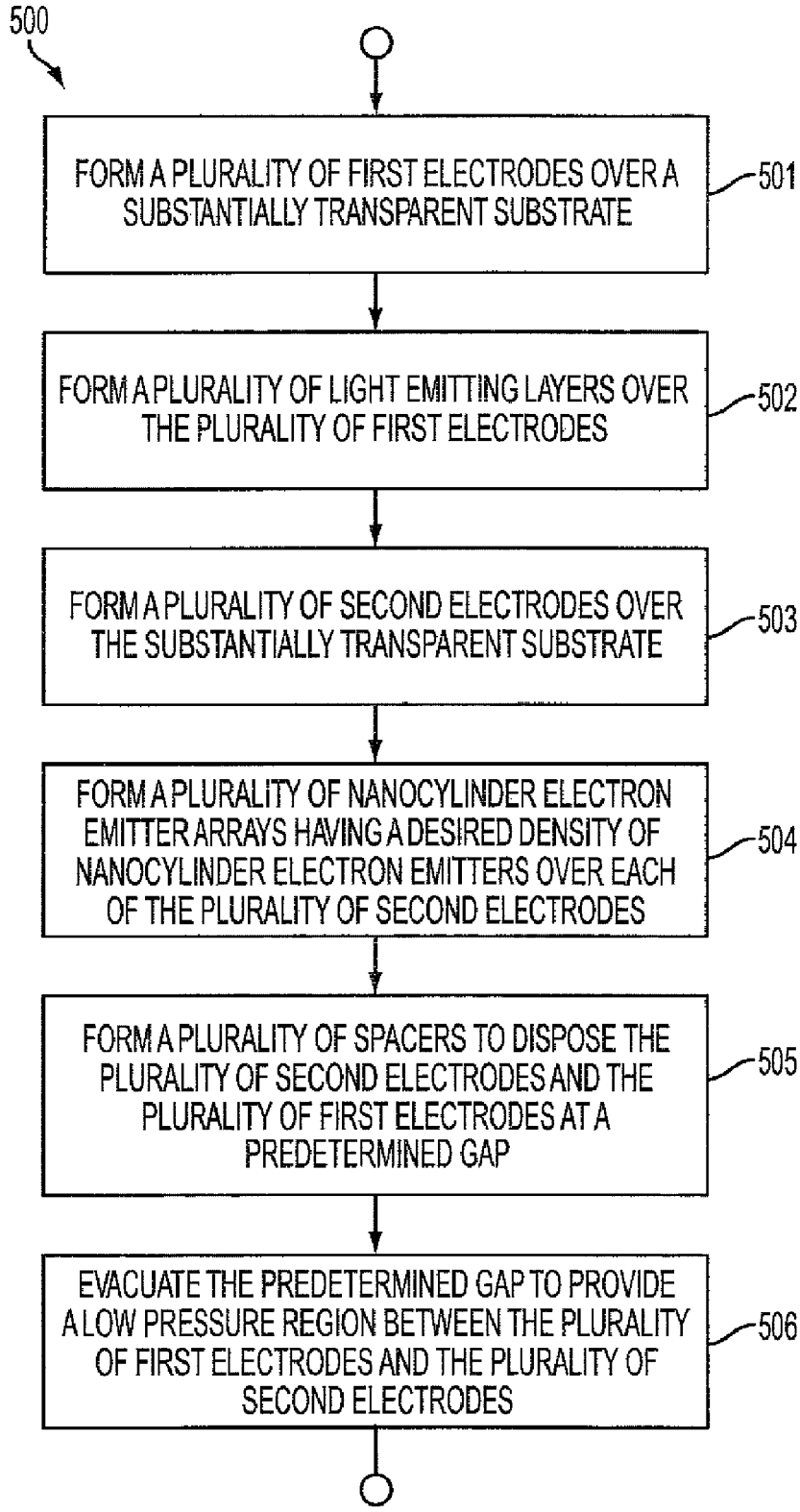
FIG. 5 illustrates an exemplary method of making a field emission light emitting device, in accordance with the present teachings.

According to various embodiments, there is a method 500 of forming a field emission light emitting device 400A, 400C, 400D, 400E, as shown in FIG. 5. The method 600 can include forming a plurality of first electrodes 440 over a substantially transparent substrate 450, as in step 501 and forming a plurality of light emitting layers 462, 464, 466 over the plurality of first electrodes 440, as in step 502, wherein each of the plurality of first electrodes 440 can include a substantially transparent conductive material. The method 500 can also include forming a plurality of second electrodes 420 over the substantially transparent substrate 450, as in step 503 and forming a plurality of nanocylinder electron emitter arrays 430, 430' having a desired density of nanocylinder electron emitters over the plurality of second electrodes 420, as in step 504, wherein each of the plurality of nanocylinder electron emitter has a first end and a second end and the first end can be connected to the second electrode 420 while the second end can be disposed to emit electrons. In various embodiments, each of the plurality of second electrodes 420 can be disposed over a dielectric layer 425. The method 500 can further include forming a plurality of spacers 490 to dispose the plurality of second electrodes 420 and the plurality of first electrodes 440 at a predetermined gap, as in step 505 and evacuating the predetermined gap to provide a low pressure region between the plurality of first electrodes 440 and the plurality of second electrodes 420, as in step 506. In various embodiments, the method can also include forming a plurality of fourth electrodes over a backing substrate 410, wherein the backing substrate 410 can be substantially parallel to the substantially transparent substrate 450. In some embodiments, the method can include forming the plurality of nanocylinder electron emitter arrays 430' having a desired density of nanocylinder electron emitters in a dielectric matrix and forming a third electrode layer over the dielectric matrix, wherein the distance between the third electrode layer and the second end of the nanocylinder electron emitter can be about the average diameter of the nanocylinder electron emitter. In certain embodiments, the step of forming a plurality of light emitting layers 462, 464, 466 can include forming one or more of a first plurality of light emitting phosphor layers 462 having a first color, a second plurality of light emitting phosphor layers 464 having a second color, and a third plurality of light emitting phosphor layers 466 having a third color.

Figure 6:
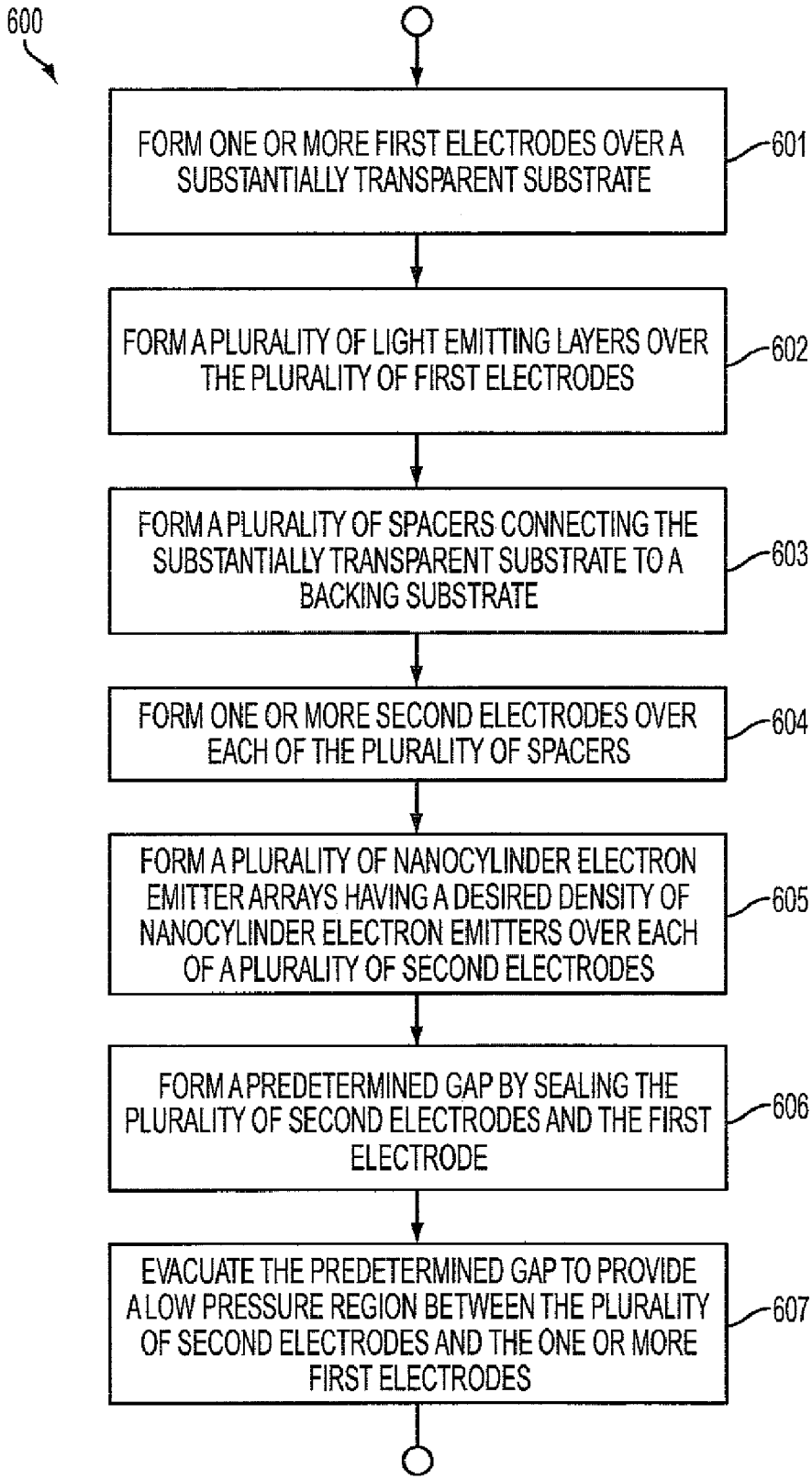
FIG. 6 illustrates another exemplary method of making a field emission light emitting device, in accordance with the present teachings.

According to various embodiments, there is a method 600 of forming a field emission light emitting device 300A, 300B, 300C, 400D, as shown in FIG. 6. The method can include forming one or more first electrodes 340 over a substantially transparent substrate 350, as in step 601 and forming a plurality of light emitting layers 362, 364, 366 over the plurality of first electrodes 340, as in step 602. The method 600 can also include forming a plurality of spacers 390 connecting the substantially transparent substrate to a backing substrate 350, as in step 603 and forming one or more second electrodes 320 over each of the plurality of spacers 390, as in step 604. The method 600 can further include step 605 of forming a plurality of nanocylinder electron emitter arrays 330, 330' having a desired density of nanocylinder electron emitters over each of the plurality of second electrodes 320 and step 606 of forming a predetermined gap by sealing the plurality of second electrodes 320 and the first electrode 340. The method 600 can also include evacuating the predetermined gap to provide a low pressure region between the one or more second electrodes 320 and the one or more first electrodes 340.

In various embodiments, the FELED 200A, 200B, 300A, 300B, 300C, 300D, 400A, 400C, 400D, 400E can be an erase bar, or an imager in a digital electrophotographic printer. In some embodiments, the FELED 200A, 200B, 300A, 300B, 300C, 300D, 400A, 400C, 400D, 400E can be a flexible, light weight, low power ultra thin display panel.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A nanoscale electron emitter comprising:

a first electrode electrically connected to a first power supply;

a second electrode electrically connected to a second power supply; and a nanocylinder electron emitter array disposed over the second electrode, the nanocylinder electron emitter array comprising:

a plurality of nanocylinder electron emitters disposed in a dielectric matrix such that an average nanocylinder to nanocylinder distance is at least about one and a half times an average diameter of the nanocylinder, wherein each of the plurality of nanocylinder electron emitters comprises a first end connected to the second electrode and a second end positioned to emit electrons, the first end being opposite to the second end; and a third electrode disposed over the dielectric matrix and electrically connected to a third power supply such that a distance between the third electrode and the second end of the nanocylinder is less than about five times an average nanocylinder diameter.

2. The nanoscale electron emitter of claim 1, wherein each of the plurality of nanocylinder electron emitters has an aspect ratio of more than about 2.

3. The nanoscale electron emitter of claim 1, wherein the dielectric matrix comprises one or more materials selected from a group consisting of a polymer, a block co-polymer, a polymer blend, a crosslinked polymer, a track-etched polymer, and an anodized aluminum.

4. The nanoscale electron emitter of claim 1, wherein each of the plurality of nanocylinder electron emitters is disposed in the dielectric matrix, such that an average nanocylinder electron emitter to nanocylinder electron emitter distance is equal to or greater than an average height of the nanocylinder electron emitters.

5. A field emission light emitting device comprising:

a substantially transparent substrate;

a plurality of spacers, wherein each of the plurality of spacers connects the substantially transparent substrate to a backing substrate; and a plurality of pixels, each of the plurality of pixels separated by one or more spacers, wherein each of the plurality of pixels comprises:

one or more first electrodes disposed over the substantially transparent substrate, wherein each of the one or more first electrodes comprises a substantially transparent conductive material;

a light emitting layer disposed over the one of the one or more first electrodes;

one or more second electrodes disposed over each of the plurality of spacers, wherein the second electrodes are disposed at an angle to the first electrodes; and one or more nanocylinder electron emitter arrays disposed over each of the one or more second electrodes, the nanocylinder electron emitter array comprising a plurality of nanocylinder electron emitters disposed in a dielectric matrix, wherein each of the plurality of nanocylinder electron emitters comprises a first end connected to the second electrode and a second end positioned to emit electrons, wherein the one or more second electrodes and the one or more first electrode are disposed at a predetermined gap in a low pressure region, and wherein each of the plurality of pixels is connected to a power supply and is adapted to be operated independent of the other pixels.

6. The field emission light emitting device of claim 5, wherein each of the plurality of nanocylinder electron emitters has an aspect ratio of more than about 2.

7. The field emission light emitting device of claim 5, wherein an average nanocylinder electron emitter to nanocylinder electron emitter distance is at least about an average height of the nanocylinder electron emitter.

8. The field emission light emitting device of claim 5, wherein the dielectric matrix comprises one or more materials selected from a group consisting of a polymer, a block co-polymer, a polymer blend, a crosslinked polymer, a track-etched polymer, and an anodized aluminum.

9. The field emission light emitting device of claim 5, wherein each of the one or more nanocylinder electron emitter arrays comprises:

a plurality of nanocylinder electron emitters disposed in a dielectric matrix such that an average nanocylinder electron emitter to nanocylinder electron emitter distance is at least about one and a half times an average diameter of the nanocylinder electron emitter;

a third electrode disposed over the dielectric matrix such that a distance between the third electrode and the second end of the nanocylinder electron emitter is less than about five times the diameter of the nanocylinder electron emitter.

10. The field emission light emitting device of claim 5, wherein each of the plurality of pixels further comprises one or more fourth electrodes disposed over the backing substrate.

11. The field emission light emitting device of claim 5, wherein the light emitting layer comprises a light emitting phosphor material having a light emitting color selected from a group consisting of red, green, blue, and combinations thereof.

12. The field emission light emitting device of claim 5, wherein each of the plurality of spacers comprises one or more contrast enhancing materials.

13. The field emission light emitting device of claim 5 further comprising a plurality of voltage withstand layers, wherein each of the plurality of voltage withstand layers is disposed over the light emitting layer.

14. A field emission light emitting device comprising:

a substantially transparent substrate;

a plurality of spacers, wherein each of the plurality of spacers connects the substantially transparent substrate to a backing substrate and comprises one or more contrast enhancing materials; and a plurality of pixels, each of the plurality of pixels separated by one or more spacers, wherein each of the plurality of pixels comprises:

one or more first electrodes disposed over the substantially transparent substrate, wherein the one or more first electrodes comprises a substantially transparent conductive material;

a light emitting layer disposed over the first electrode;

one or more second electrodes disposed over the substantially transparent substrate;

one or more nanocylinder electron emitter arrays disposed over the one or more second electrodes, the plurality of nanocylinder electron emitter arrays comprising a plurality of nanocylinder electron emitters, wherein each of the plurality of nanocylinder electron emitters comprises a first end connected to the second electrode and a second end positioned to emit electrons, wherein each of the plurality of pixels is connected to a power supply and is adapted to be operated independent of the other pixels.

15. The field emission light emitting device of claim 14, wherein each of the plurality of nanocylinder electron emitters has an aspect ratio of more than about 2.

16. The field emission light emitting device of claim 14, wherein an average nanocylinder electron emitter to nanocylinder electron emitter distance is at least about an average height of the nanocylinder electron emitter.

17. The field emission light emitting device of claim 14, wherein the plurality of nanocylinder electron emitters is disposed in a dielectric matrix, wherein the dielectric matrix comprises one or more materials selected from a group consisting of a polymer, a block co-polymer, a polymer blend, a crosslinked polymer, a track-etched polymer, and an anodized aluminum.

18. The field emission light emitting device of claim 14, wherein each of plurality of the nanocylinder electron emitter arrays comprises:

a plurality of nanocylinder electron emitters disposed in a dielectric matrix such that an average nanocylinder electron emitter to nanocylinder electron emitter distance is at least about one and a half times an average diameter of the nanocylinder electron emitter;

a third electrode disposed over the dielectric matrix such that a distance between the third electrode and the second end of the nanocylinder electron emitter is less than about five times the nanocylinder electron emitter diameter.

19. The field emission light emitting device of claim 14, wherein each of the plurality of pixels further comprises one or more third electrodes disposed over the backing substrate.

20. The field emission light emitting device of claim 14, wherein the light emitting layer comprises a light emitting phosphor material having a light emitting color selected from a group consisting of red, green, blue, and combinations thereof.

21. The field emission light emitting device of claim 14 further comprising a plurality of voltage withstand layers, wherein each of the plurality of voltage withstand layers is disposed over the light emitting layer.

22. A field emission light emitting device comprising:

a substantially transparent substrate;

a plurality of spacers, wherein each of the plurality of spacers connects the substantially transparent substrate to a backing substrate; and a plurality of pixels, each of the plurality of pixels separated by one or more spacers, wherein each of the plurality of pixels comprises:

one or more first electrodes disposed over the substantially transparent substrate, wherein the one or more first electrodes comprises a substantially transparent conductive material;

a light emitting layer disposed over the first electrode;

one or more second electrodes disposed over the substantially transparent substrate;

one or more nanocylinder electron emitter arrays disposed over the one or more second electrodes, the plurality of nanocylinder electron emitter arrays comprising a plurality of nanocylinder electron emitters, wherein each of the plurality of nanocylinder electron emitters comprises a first end connected to the second electrode and a second end positioned to emit electrons, wherein each of the plurality of pixels is connected to a power supply and is adapted to be operated independent of the other pixels; and a plurality of voltage withstand layers, wherein each of the plurality of voltage withstand layers is disposed over the light emitting layer.

* * * * *